US011179614B2

(12) United States Patent
Kim

(10) Patent No.: US 11,179,614 B2
(45) Date of Patent: Nov. 23, 2021

(54) PUTTING TRAINING DEVICE AND METHOD OF PROVIDING SWING POSTURE COACHING INFORMATION USING THE SAME

(71) Applicant: Jong gi Kim, Incheon (KR)

(72) Inventor: Jong gi Kim, Incheon (KR)

( * ) Notice: Subject to any disclaimer, the term of this patent is extended or adjusted under 35 U.S.C. 154(b) by 35 days.

(21) Appl. No.: 16/708,957

(22) Filed: Dec. 10, 2019

(65) Prior Publication Data

US 2021/0046371 A1 Feb. 18, 2021

(30) Foreign Application Priority Data

Aug. 16, 2019 (KR) ..... 10-2019-0100049
Nov. 6, 2019 (KR) ..... 10-2019-0140599

(51) Int. Cl.
*A63B 69/36* (2006.01)

(52) U.S. Cl.
CPC .. *A63B 69/3685* (2013.01); *A63B 2208/0204* (2013.01); *A63B 2225/093* (2013.01)

(58) Field of Classification Search
CPC ..... A63B 69/3685; A63B 69/3676; A63B 69/3667; A63B 2225/093; A63B 2208/0204
See application file for complete search history.

(56) References Cited

U.S. PATENT DOCUMENTS 5,156,401 A * 10/1992 Hodgkiss ..... A63B 69/3632 473/227
5,248,146 A * 9/1993 Viets ..... A63B 69/0059 473/206
5,259,621 A * 11/1993 Keefer ..... A63B 69/0059 473/212
5,904,624 A * 5/1999 Martinez ..... A63B 69/3685 273/DIG. 30
6,932,713 B1 * 8/2005 Kim ..... A63B 69/3608 473/227
8,496,537 B1 * 7/2013 Shao ..... A63B 69/3676 473/227
8,696,481 B1 * 4/2014 Allen ..... A63B 69/3676 473/208

(Continued)

FOREIGN PATENT DOCUMENTS

CA 2379779 A1 * 2/2001 ..... A63B 69/3632
JP 2003230648 A 8/2003

(Continued)

*Primary Examiner* — Raleigh W Chiu
(74) *Attorney, Agent, or Firm* — Novick, Kim & Lee, PLLC; Jae Youn Kim; Jihun Kim

(57) ABSTRACT

A putting training device includes a fixing hub including a shaft retainer combined with a putter shaft; a first rotary support and a second rotary support coupled to the block part at both sides of the putter shaft, respectively; a first support bar having an upper end supposed to be held in an underarm of a user and the other end rotatably coupled to the first rotary support; a second support bar having an upper end supposed to be held in the underarm of the user and the other end rotatably coupled to the second rotary support; and an angle adjuster coupled to the first support bar and the second support bar over the first rotary support and the second rotary support to be able to adjust an angle between the first support bar and the second support bar.

17 Claims, 17 Drawing Sheets

(56) References Cited

U.S. PATENT DOCUMENTS

| | | | | |
|---|---|---|---|---|
| 9,943,743 | B1 * | 4/2018 | Diley | A63B 69/3685 |
| 10,463,941 | B1 * | 11/2019 | Isbell | A63B 53/005 |
| 2001/0021674 | A1 * | 9/2001 | Takase | A63B 69/0059<br>473/212 |
| 2002/0016211 | A1 * | 2/2002 | Moran | A63B 69/3632<br>473/226 |
| 2011/0111876 | A1 * | 5/2011 | Hart | A63B 69/3667<br>473/257 |
| 2011/0269562 | A1 * | 11/2011 | Pinns | A63B 69/0059<br>473/227 |
| 2016/0193519 | A1 * | 7/2016 | Awad | A63B 69/3608<br>473/212 |
| 2018/0028893 | A1 * | 2/2018 | Herberth | A63B 69/3632 |
| 2019/0192943 | A1 | 6/2019 | Mclendon | |

FOREIGN PATENT DOCUMENTS

| | | | | | |
|---|---|---|---|---|---|
| JP | 3178522 | U | | 9/2012 | |
| KR | 100490477 | B1 | | 5/2005 | |
| KR | 100794369 | B1 | | 1/2008 | |
| KR | 100917899 | B1 | | 9/2009 | |
| KR | 2079001 | | * | 2/2020 | A63B 69/3608 |
| KR | 102079001 | B1 | * | 2/2020 | A63B 69/36 |
| KR | 2129403 | | * | 7/2020 | A63B 60/06 |

* cited by examiner

PUTTING TRAINING DEVICE AND METHOD OF PROVIDING SWING POSTURE COACHING INFORMATION USING THE SAME

BACKGROUND OF THE INVENTION

Field of the Invention

The present invention relates to a putting training device and a method of providing swing posture coaching information using the same and, more particularly, to a putting training device that is directly applied to the body of a user so that the user can effectively learn an accurate putting posture by integrally moving the user's shoulders and hands and a putter, and a method of providing swing posture coaching information using sensors and a dedicated application.

Description of the Related Art

Putting is an action of hitting a golf ball on the green so that it goes into a hole in golf. The accuracy of putting has a decisive influence on the score in golf. It is very important to stably stroke without shaking and accurately hit a golf ball for accurate putting. A stroke may be classified into a backstroke that swings a putter backward to hit a golf ball, a forward stroke that swings a putter forward to hit a golf ball, and a follow-through that keeps moving a predetermined distance forward in the traveling direction of a golf ball after hitting.

A putter has a grip which is supposed to be held by hands, a putter shaft connected to the grip, and a head formed at the lower end of the shaft to directly hit a golf ball to be suitable for sending a golf ball a short distance.

A putting posture is important for a high score. It is preferable to make an inverse triangle with shoulders and hands holding a grip and it is preferable to keep the inverse-triangular posture during the strokes described above.

However, in putting, the strokes are slower than swings when other golf clubs are used, and it is difficult to putt in a stable and preferable posture due to unstable actions such as moving the head left and right or bending the wrists in stroking.

Devices or tools for training users in a putting posture and strokes have been disclosed. For example, a method of pointing out problems with swing by sensing a swing posture and a swing result through a training device and analyzing them through software has been disclosed. However, this method is a resultant analysis method and has a problem that users only mentally understand and cannot physically learn strokes or a putting posture in person.

Further, although devices that correct a putting posture by being directly applied to the users' bodies have been disclosed in the related art, these devices have complicated configuration and are not training devices that enable users to physically learn a putting posture in an inverse triangular posture with consistency, so there is a demand for such a putting training device.

CITATION LIST

Patent Literature

Patent Literature 1: U.S. Pat. No. 9,943,743

SUMMARY OF THE INVENTION

An object of the present invention is to provide a putting training device that has a simple configuration, is easily used and handled, and enables a user to learn a putting posture and a stroke posture by being directly applied to the user's body.

An object of the present invention is to provide a method of providing coaching information for correcting a swing posture by installing sensors in a putting training device and installing a dedicated application in a smartphone.

In order to achieve the objects, an embodiment of the present invention provides a putting training device that trains a user in a putting posture formed by relative positions of the user's shoulders and the user's hands holding a grip of a putter. The putting training device includes: a fixing hub including a shaft retainer combined with a putter shaft such that the putter shaft under a grip of the putter vertically passes through the shaft retainer in a preparation state with a head of a putter positioned close to a golf ball, and a block part formed at an upper end of the shaft retainer; a first rotary support and a second rotary support coupled to the block part at both sides of the putter shaft, respectively; a first support bar having an upper end supposed to be held in an underarm of a user and the other end rotatably coupled to the first rotary support; a second support bar having an upper end supposed to be held in the other underarm of the user and the other end rotatably coupled to the second rotary support; and an angle adjuster coupled to the first support bar and the second support bar over the first rotary support and the second rotary support to be able to adjust an angle between the first support bar and the second support bar.

In order to achieve the objects, another embodiment of the present invention provides a putting training device that trains a user in a putting posture formed by relative positions of the user's shoulders and the user's hands holding a grip of a putter. The putting training device includes: a fixing hub including a shaft retainer coupled to an outer side of a shaft of a putter under a grip of the putter in a preparation state with the head of the putter positioned close to a golf ball, and a fixing frame to which the shaft retainer is coupled; a first support bar and a second support bar positioned between the fixing hub and the underarms of a user, respectively; an angle adjuster coupled to the fixing frame, coupled to a lower portion of the first support bar and a lower portion of the second support bar, and having a rotary structure being able to adjust a contained angle between the first support bar and the second support bar; and a first underarm part and a second underarm part coupled to upper ends of the first support bar and the second support bar, respectively, supposed to be held in the underarms of the users, respectively, and each including an underarm support coupled to an upper end of the first support bar and having an accommodation groove, an underarm surface coupled to the underarm support and having a top surface supposed to come in contact with an underarm of a user, and an elastic member inserted in the accommodation groove and elastically supporting the underarm support.

In order to achieve the objects, another embodiment of the present invention provides a method of providing swing posture coaching information using a transmitted signal. In the method of providing swing posture coaching information, first, a multi-axial inertia sensor that measures three-axial acceleration and positions, and direction is installed at the putting training device of any one of claims 1 and 12. Thereafter, a posture information signal including three-axial acceleration, position, and direction information sensed by the multi-axial inertia sensor is transmitted to a terminal when a user swings or putts. Thereafter, swing posture coaching information is provided to the user by processing the posture information signal through the dedicated putting posture training application installed in the terminal.

In an embodiment of the present invention, the multi-axial inertia sensor may be installed at the first support bar, the second support bar, and the fixing hub, respectively, the terminal may be a smartphone, and the dedicated software may be a dedicated putting posture training application installed in the smartphone.

In an embodiment of the present invention, the dedicated application may receive posture information signals from three multi-axial inertia sensors installed at the first support bar, the second support bar, and the fixing hub; may derive X-axial, Y-axial, and Z-axial acceleration and force from the posture information signal obtained from the acceleration sensor, and may derive the movement direction of the user's arms and the rotational direction of the user's hands from the posture information signal obtained by the gyroscope sensor; and may determine the points in time of starting and finishing swinging or putting from the point in time when the sign of specific axial signal of the X, Y, and Z axes changes, and may derive a height change by accumulating data about the movement direction of the arms and the rotational direction of the hands, thereby being able to create swing posture coaching information.

DETAILED DESCRIPTION OF THE PREFERRED EMBODIMENTS

Figure 1:
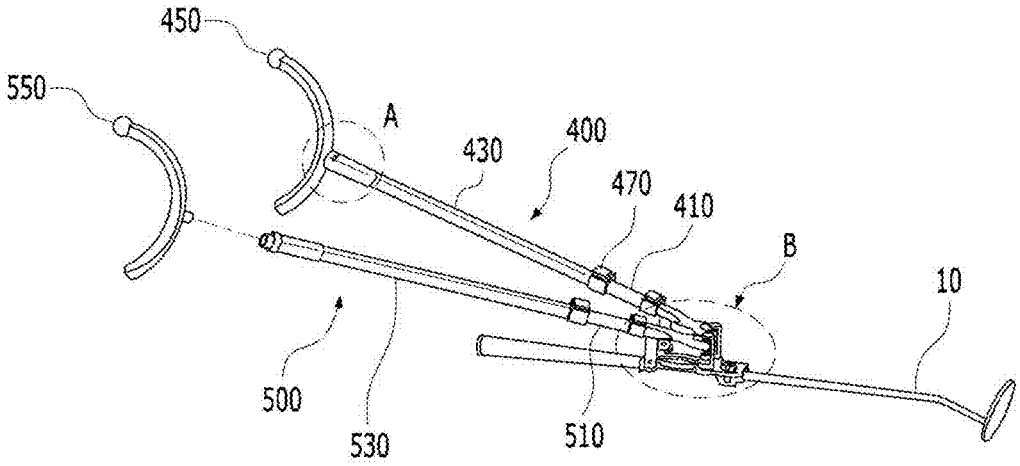
FIGS. 1 and 2 are views showing a putting training device according to an embodiment of the present invention.

Hereinafter, the present invention is described with reference to the accompanying drawings. However, the present invention may be modified in various different ways and is not limited to the embodiments described herein. Further, in the accompanying drawings, components irrelevant to the description will be omitted in order to obviously describe the present invention, and similar reference numerals will be used to describe similar components throughout the specification.

Throughout the specification, when an element is referred to as being "connected with (coupled to, combined with, in contact with)" another element, it may be "directly connected" to the other element and may also be "indirectly connected" to the other element with another element intervening therebetween. Further, unless explicitly described otherwise, "comprising" any components will be understood to imply the inclusion of other components rather than the exclusion of any other components.

Terms used in the present invention are used only in order to describe specific exemplary embodiments rather than limiting the present invention. Singular forms are intended to include plural forms unless the context clearly indicates otherwise. It will be further understood that the terms "comprise" or "have" used in this specification specify the presence of stated features, steps, operations, components, parts, or a combination thereof, but do not preclude the presence or addition of one or more other features, numerals, steps, operations, components, parts, or a combination thereof.

Hereinafter, embodiments are described in detail with reference to the accompanying drawings.

Figure 2:
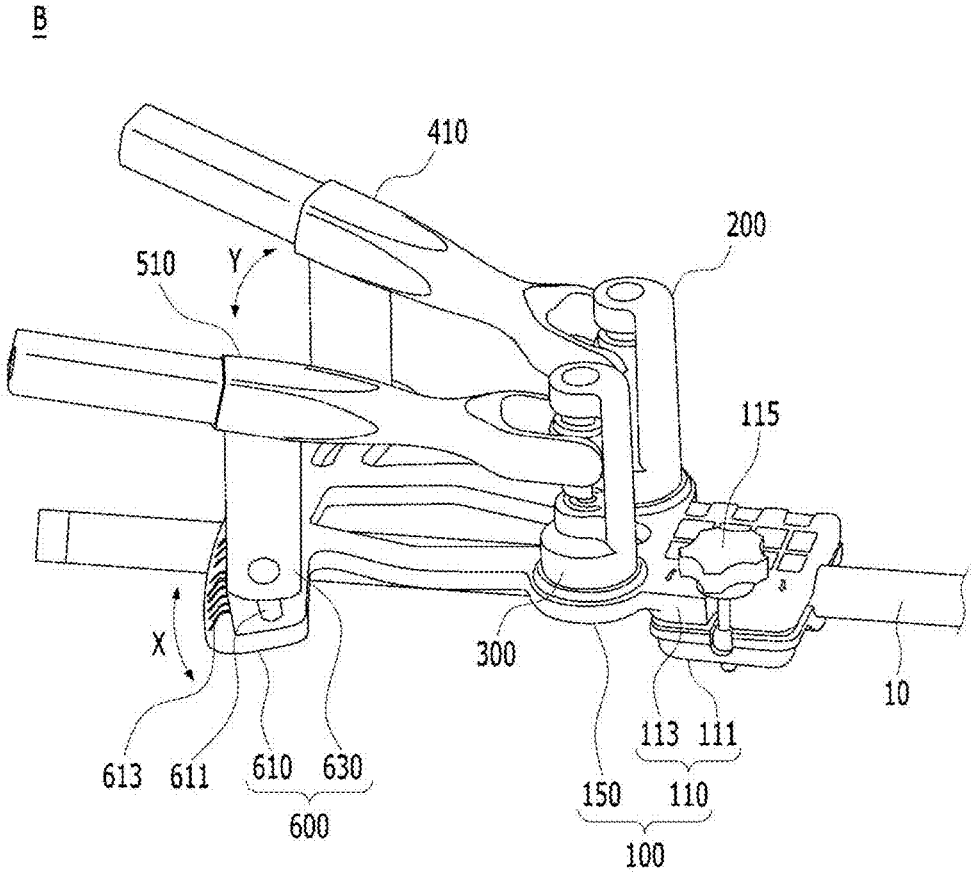

FIGS. 1 and 2 are views showing a putting training device according to an embodiment of the present invention.

The putting training device can be applied to training a user in a putting posture formed by relative positions of the user's shoulders and the user's hands holding a grip of a putter 10. For example, it has been known as being preferable that the user's shoulders and the user's hands holding the grip of the putter 10 make an inverse triangle as a putting posture. The putting training device of this embodiment helps keep a preferable putting device from the start to the end of a stroke. In particular, the putting training device has an advantage that a training effect can be memorized in the body of a user because it is directly applied to the body, and it has a simple structure and is easily handled.

The putting training device may include a fixing hub 100, a first rotary support 200, a second rotary support 300, a first support bar 400, a second support bar 500, and an angle adjuster 600.

Hereafter, directions or positional relationships are described on the basis of the putter 10 in a preparation state with the head of the putter 10 positioned close to a golf ball.

The fixing hub 100 may include a shaft retainer 110 and a block part 150. The fixing hub 100 may be injection molding or a molding formed by a mold. Alternatively, the fixing hub 100 may be formed in a frame shape formed by welding or bolting a metallic pipe or band member.

The shaft retainer 110 may have a hollow cylindrical shape. The shaft retainer 110 may be combined with a putter shaft such that the putter shaft under a putter grip vertically passes through the hollow cylindrical shape. The shaft retainer 110 may have an appropriate structure to which a putter shaft can be coupled or fixed such as an openable pipe shape or sleeve shape, or an openable ring member.

The block part 150 may be a predetermined supporting part integrally formed at the upper end of the shaft retainer 110.

The first rotary support 200 and the second rotary support 300 can be coupled with the putter shaft therebetween, that is, to the block part 150 at both sides of putter shaft.

In the first support bar 400, an upper end is supposed to be held under a user's arm and a lower end can be rotatably coupled to the first rotary support 200.

In the second support bar 500, an upper end is supposed to be held under the user's other arm and a lower end can be rotatably coupled to the second rotary support 300.

The first rotary support 200 and the second rotary support 300 each may have a rod shape protruding forward from the block part 150.

The lower ends of the first support bar 400 and the second support bar 500 may be coupled to the first rotary support 200 and the second rotary support 300, respectively, at positions spaced forward apart from the block part 150. Accordingly, a putter 10 fixed to the shaft retainer 110 can be positioned behind the first support bar 400 and the second support bar 500.

Further, the lower ends of the first support bar 400 and the second support bar 500 are positioned at the block part 150 and the shaft retainer 110 is positioned under the block part 150, so interference with other members is prevented when the shaft of the putter 10 is mounted/separated onto/from the shaft retainer 110, whereby it is possible to conveniently mount and separate the putter to and from the shaft retainer 110.

The angle adjuster 600 may be coupled to the first support bar 400 and the second support bar 500 from behind the upper portion of the first rotary support 200 and the second rotary support 300 so that the angle between the first support bar 400 and the second support bar 500 can be adjusted. Obviously, the angle adjuster 600 may be coupled to the first support bar 400 and the second support bar 500 from ahead of the upper portions of the first rotary support 200 and the second rotary support 300.

The angle adjuster 600 may include an angle adjustment frame 610 and a pair of angle adjustment locks 630.

Guide holes 611 for adjusting the angle between the first support bar 400 and the second support bar 500 are formed through the angle adjustment frame 610. An angle adjustment scale 613 may be formed at the upper edge of the angle adjustment frame 610 so that a user can recognize it when looking down. The angle adjustment frame 610 may be coupled to lower bars of the first support bar 400 and the second support bar 500 from behind the bars.

The pair of angle adjustment locks 630 each may have an end fastened to the lower bar and the other end that can be slid and fixed in the guide hole 611.

Figure 3:
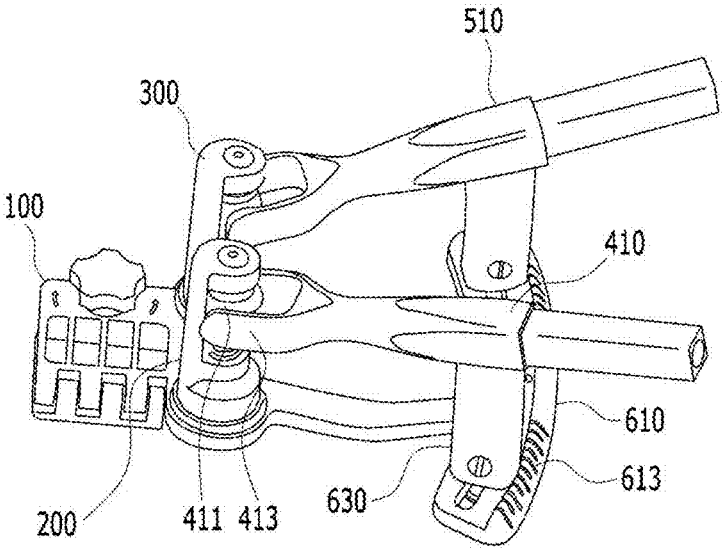
FIGS. 3 and 4 are views for describing the putting training device according to an embodiment of the present invention.
Figure 4:
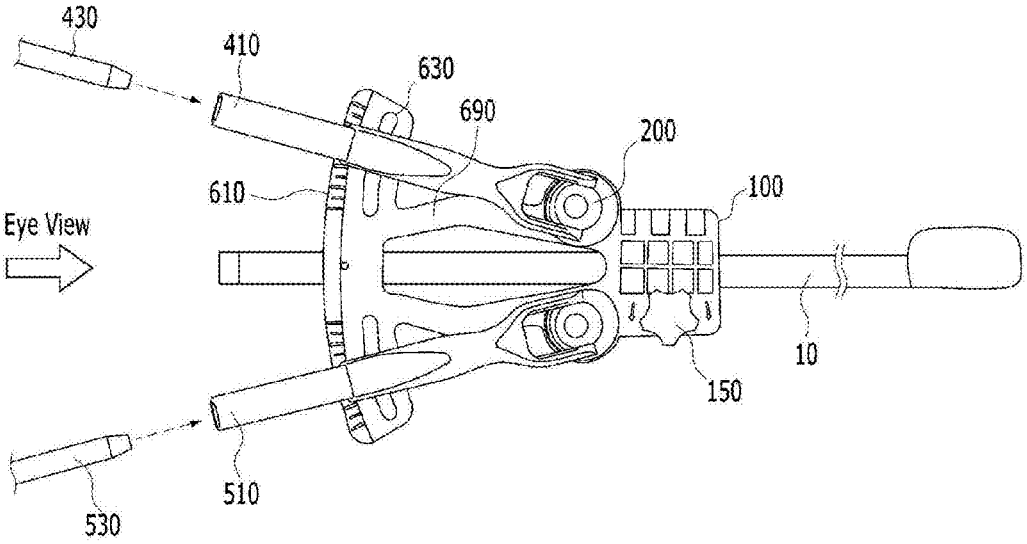
Figure 5:
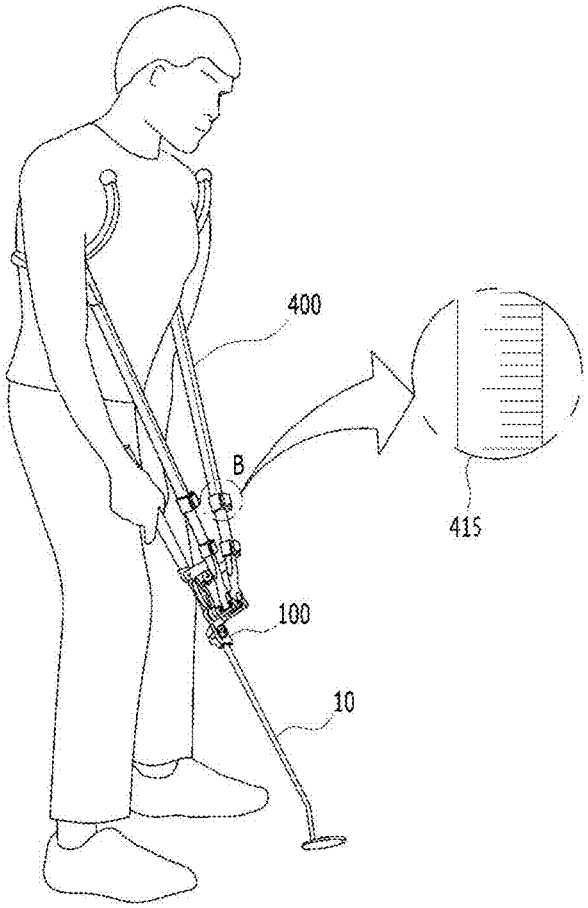
FIG. 5 is a view showing an example of a method in which a user uses the putting training device according to an embodiment of the present invention.

FIGS. 3 and 4 are views for describing the putting training device according to an embodiment of the present invention. FIG. 5 is a view showing an example of a method in which a user uses the putting training device according to an embodiment of the present invention.

The first support bar 400 may include a lower bar 410, an upper bar 430, a underarm part 450, and a length adjustment lock 470 (see FIG. 1).

The lower end of the lower bar 410 can be rotatably coupled to the first rotary support 200. As described above, the lower end of the lower bar 410 may be coupled to the first rotary support 200 to be able to rotate left and right.

For example, the lower end of the lower bar 410 may include a rotary member 411 and a connecting portion 413.

The rotary member 411 may be coupled to the first rotary support 200 to be able to rotate forward and rearward (see rotation X in FIG. 2). The direction "forward and rearward" is defined as a direction that faces the putter 10 from a user when the user holds the putter 10 coupled to the putting training device (see FIG. 5). The rotational range may be limited to a range that is allowed by the angle adjuster 600.

The connecting portion 413 may be coupled to the rotary member 411 to be able to rotate left and right. For example, the connecting portion 413 may have fixing fingers diverging from both sides to face each other and the fixing fingers may be thread-fastened to both sides of the rotary member 411 while facing each other or may be inserted in holes on sides of the rotary member 411. Other various rotatable fastening types may be possible (see FIG. 3).

Although it was exemplified above that a kind of hinge structure is applied between the first support bar 400 and the second support bar 500 and between the first rotary support 200 and the second rotary support 300, a ball-fastened structure that is changed to predetermined angles may be selected as the rotatable coupling between the bars and supports.

The upper bar 430 can be separated from and coupled to the lower bar 410. For example, the lower bar 410 may be coupled to the upper bar 430 such that the upper end thereof is fitted on the lower end of the upper bar 430 to adjust the length. Accordingly, the upper bar 430 may have a hollow pipe shape.

The lower bar 410 is fitted on the upper bar 430, so the length of the first support bar 400 can be adjusted. Accordingly, the length can be adjusted to fit to the height or the body size of a user.

The length adjustment lock 470 may be coupled to the lower bar 410 or the upper bar 430 to prevent the lower bar 410 from sliding after the length is adjusted.

The underarm part 450 is coupled to the upper end of the upper bar 430 to be detachable in a one-touch type (see FIG. 1) and may have an arc shape so it can be held under a user's arm.

The second support bar 500 may have the same structure as that of the first support bar 400. That is, the second support bar 500 may include a lower bar 510, an upper bar 530, an underarm part 550, and a length adjustment lock to correspond to the first support bar 400. This configuration is the same or similar as that of the first support bar 400, so it is not described. The description about the first support bar 400 is applied in the same way or similarly to the second support bar 500, so repeated description is omitted.

In this embodiment, the lower bar 410 and the upper bar 430 may have a rectangular cross-section so that relative rotation is prevented. Accordingly, there is no inconvenience of fitting the bars again due to unnecessary rotation when the lower bar is fitted or slid on the upper bar 430.

Further, a height scale 415 may be marked on a surface, for example, the rear face of the lower bar 410 (see FIG. 5). It is possible to conveniently adjust the length by referring to the height scale 415 as moving up and down the upper bar 430 in the lower bar 410 while fitting the lower bar 410 on the upper bar 430.

As described above, the angle adjustment frame 610 may be positioned over the shaft retainer 110 and may have a bending shape so that the angles of the first support bar 400 and the second support bar 500 are conveniently adjusted.

A shaft groove 615 in which a putter shaft is fitted from ahead or from behind is formed at the center of the angle adjustment frame 610, and extensions 690 extending from both sides of the lower end of the angle adjustment frame 610 may be integrally connected to the top surface of the block part 150. Unlikely, extensions may extend from both sides of the lower end of the angle adjustment frame 610 and may be coupled to the block part 150 of the fixing hub 100, for example, by bolting, etc.

The guide hole 611 having a curved shape may be formed at the angle adjustment frame 610, and an end of the angle adjustment lock 630 may be fastened to the lower bar 410 and the other end may slide in the guide hole 611 to adjust the angle. After the angle is adjusted, the angle adjustment frame 610 and the lower bars 410 and 510 can be fixed by tightening the angle adjustment lock 630.

Figure 6:
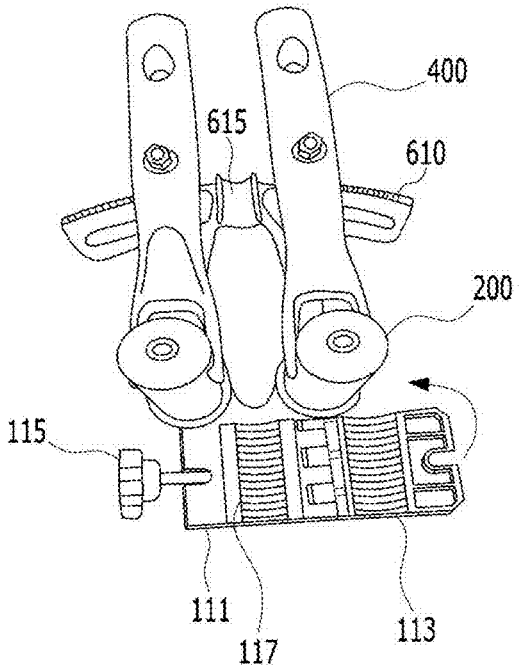
FIGS. 6 and 7 are views showing example of a method of fixing a putter shaft to a shaft retainer.
Figure 7:
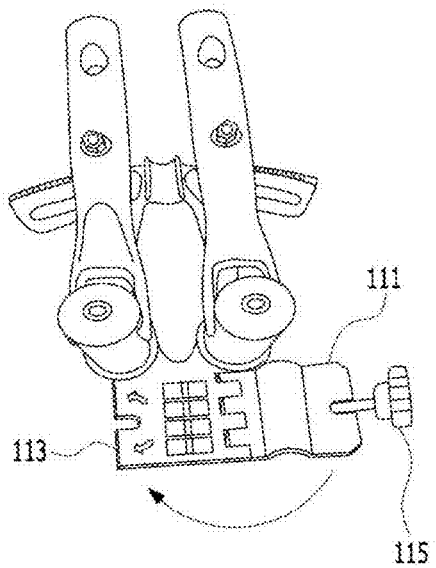

FIGS. 6 and 7 are views showing example of a method of fixing a putter shaft to the shaft retainer 110.

The shaft retainer 110 may include a first fixing part 111, a second fixing part 113, and a fastener 115. The shaft retainer 110 may have a hollow cylindrical shape, as described above. The first fixing part 111 may correspond to a half part of the cylindrical shape and the second fixing part 113 may correspond to the other half of the cylindrical shape.

The second fixing part 113 may be rotatably coupled to the first fixing part 111, for example, through a hinge structure. The fastener 115 may be installed on the first fixing part 111.

As shown in FIG. 6, the cylindrical shape may be achieved by connecting the first fixing part 111 to the block part 150 and rotating and fitting the second fixing part 113 to the first fixing part 111.

In this case, a putter shaft can be seated in the groove, that is, the inner side of the first fixing part 111 from ahead with the inner side of the first fixing part 111 open forward, and then the second fixing part 113 can be rotated to cover the surface of the putter shaft and to be fitted to the first fixing part 111. The fastener 115 may be a kind of screw, and the first fixing part 111 and the second fixing part 113 can be firmly coupled by rotating the fastener 115.

Unlikely, as shown in FIG. 7, the second fixing part 113 may be connected to the block part 150 and the first fixing part 111 can be rotated to be fitted to the second fixing part 113. In this case, the inner side of the second fixing part 113 is open rearward, a putter shaft may be seated on the second fixing part 113 from behind, the first fixing part 111 may be rotated to cover the surface of the surface of the putter shaft and to be fitted to the second fixing part 113, and then the fixing parts can be firmly coupled by tightening the fastener 115.

In an opposite way, it is possible to open the second fixing part 113 from the first fixing part 111 by loosening the fastener 115, and then separate the putter 10.

As described above, the putting training device according to this embodiment has the advantage that the attaching/detaching structure is simple and the putter 10 can be very easily attached and detached. In particular, as described above, since the shaft retainer 110 is disposed under rather than between the first support bar 400 and the second support bar 500, interference with other parts is remarkably reduced or prevented when the putter 10 is attached and detached, so convenience in use is improved.

The shaft retainer 110 may further include cushion parts 117, for example, rubber packing or a silicon packing, which are disposed on the inner side of the first fixing part 111 and the second fixing part 113 to come in contact with the shaft of a putter shaft.

An alignment mark may be formed on the shaft retainer 110 to correspond to an alignment mark formed on the grip of a putter.

Figure 8:
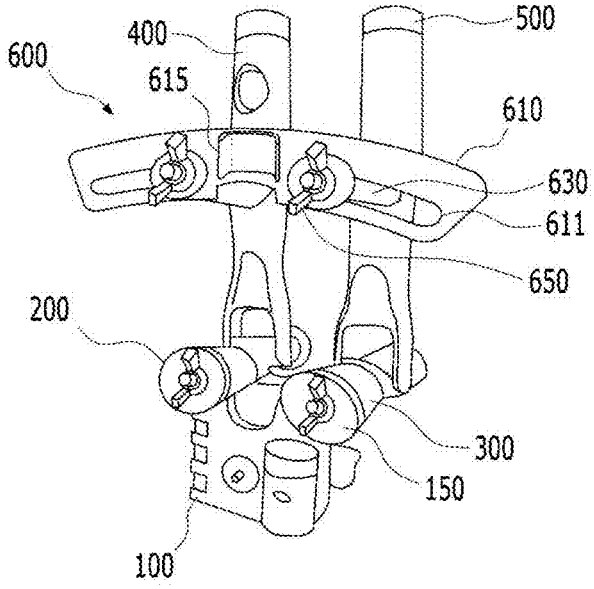
FIGS. 8 and 9 are views showing a putting training device according to another embodiment of the present invention.
Figure 9:
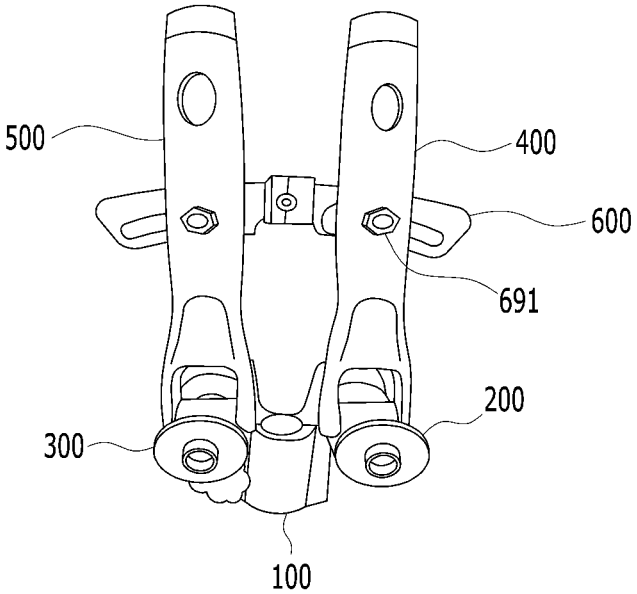

FIGS. 8 and 9 are views showing a putting training device according to another embodiment of the present invention.

The embodiment shown in FIGS. 8 and 9 is the same as or similar to the putting training device described with reference to FIGS. 1 to 7 except that the angle adjustment frame 610 of the angle adjuster 600 is a separate member rather than a member integrated with the fixing hub 1100, so repeated description is omitted.

The rotary support 200 and the second rotary support 300, as shown in FIG. 8, may be fixed to the block part 150 of the fixing hub 100 by bolting.

The angle adjustment frame 610, which is a separate member not connected with the fixing hub 100, is coupled to the first support bar 400 and the second support bar 500. The angle adjustment lock 630 may be inserted in the guide groove of the angle adjustment frame 610 and may be fastened by a member such as a bolt 691.

A plurality of fastening holes may be formed through the first support bar 400 and the second support bar 500 to be spaced up and down apart from each other so that the position where the angle adjuster 600 is coupled to the first support bar 400 and the second support bar 500 can be uniformly adjusted up and down.

Figure 10:
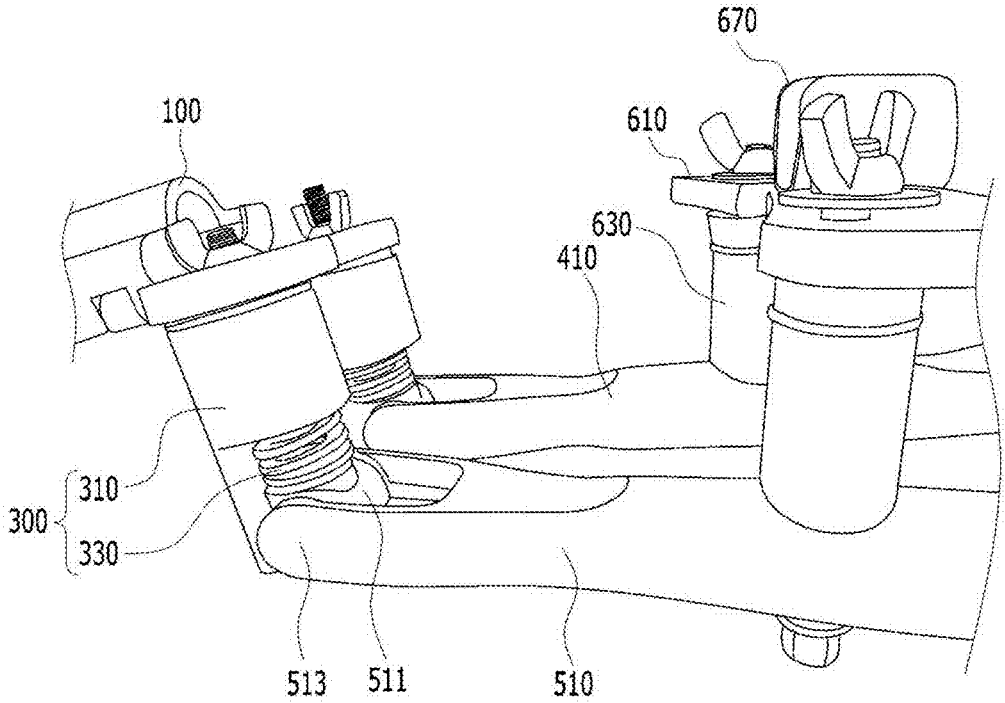
FIGS. 10 and 11 are views showing a putting training device according to another embodiment of the present invention.
Figure 11:
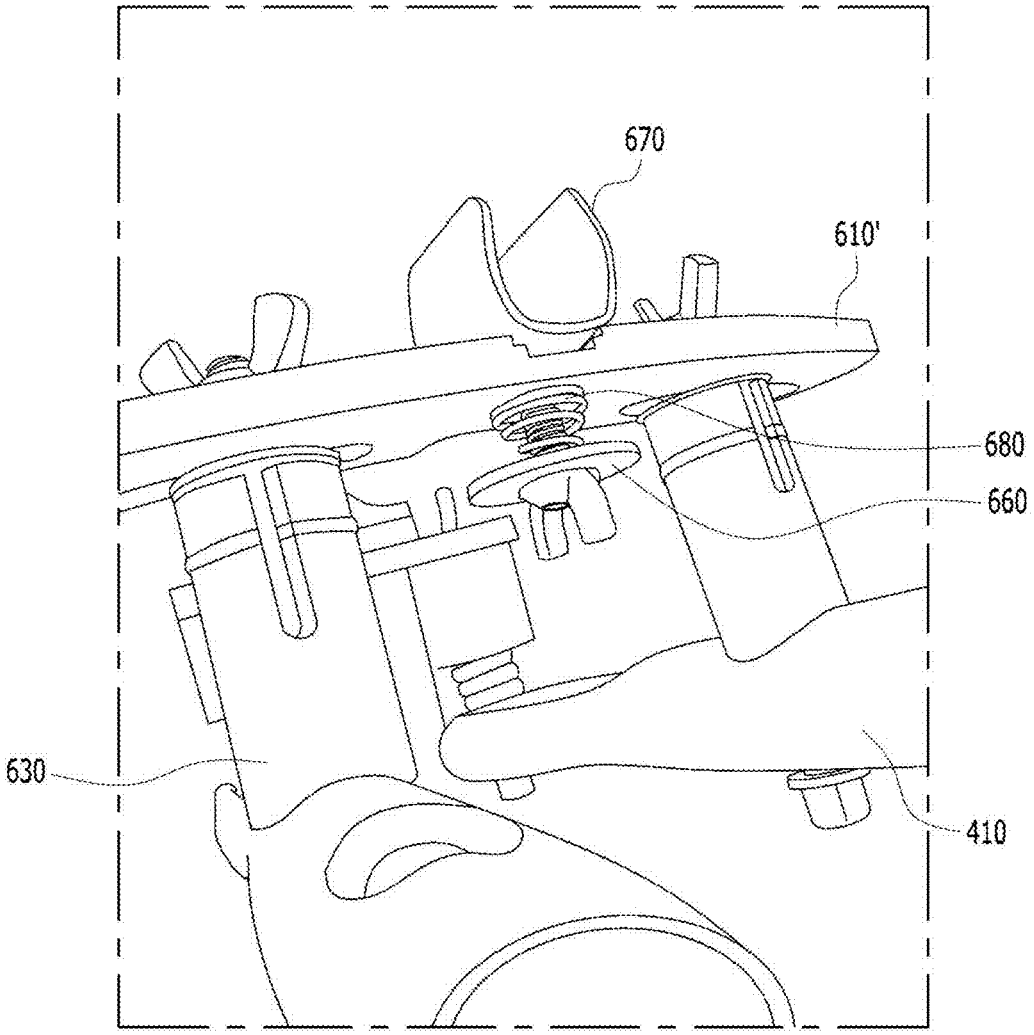

FIGS. 10 and 11 are views showing a putting training device according to another embodiment of the present invention.

In this embodiment, the putting training device, similar to the embodiments described above, may have the lower ends of the first support bar 400 and the second support bar 500, respectively, to include rotary members 411 coupled to the first rotary support 200 and the second rotary support 300 to be able to rotate forward and rearward, and connecting portions 413 coupled to the rotary members 411 to be able to rotate left and right.

The first rotary support 200 and the second rotary support 300 each may include a support body 310 and a first spring 330.

The support body 310 may be disposed through the rotary member 411. Accordingly, the rotary member 411 can rotate about the support body 310.

The first spring 330 may be disposed between the support body 310 and the rotary member 411 so that the rotary member 411 can move (be spaced) within a predetermined range along the support body 310. That is, the rotary member 411 is enabled to slightly move forward and rearward along the first rotary support 200 and the second rotary support 300 by the first spring 330, so a space in which a user can slightly move a putter fixed to a putter shaft forward and rearward can be provided.

The angle adjuster 600 may include an angle adjustment frame 610, an angle adjustment lock 630, a fixing pin 660 fastened to the angle adjustment frame 610, a ring part 670, and a second spring 680.

The ring part 670 can be fastened to the fixing pin 660 from behind. A groove in which a putter shaft is fitted my be formed at the ring portion 670. The second spring 680 is disposed between a stepped portion formed at the fixing pin 660 and the angle adjustment frame 610, whereby the ring part 670 can be spaced forward and rearward.

Due to this structure of the angle adjuster, the ring part 670 in which a putter shaft is fitted can move, so a user can control a posture better while slightly moving the putter shaft.

The putting training devices of the embodiments are very convenient to use and have the advantage in handling and storing in that the underarm parts can be attached/detached in a one-touch type, the support bars can be easily adjusted in length and easily attached/detached, and the devices can be easily fitted to the body of a user by the height scale and the angle scale.

According to the putting training devices of the embodiments described above, there is a kind of effect that fixes relative positions so that the positions of shoulders and hands are not separately moving by the first support bar 400 and the second support bar 500. That is, a user can maintain an inverse triangular structure made by the shoulders and hands when stroking, so the putter 10 is stably moved like a pendulum motion, so it is possible to hit a golf ball square through a club face (head). By repeating the action, the muscles of the body memorize a stable and preferable putting motion, thereby being able to achieve effective putting training. Accordingly, it is possible to accomplish the effect that improves the number of putting and a golf score.

Figure 12:
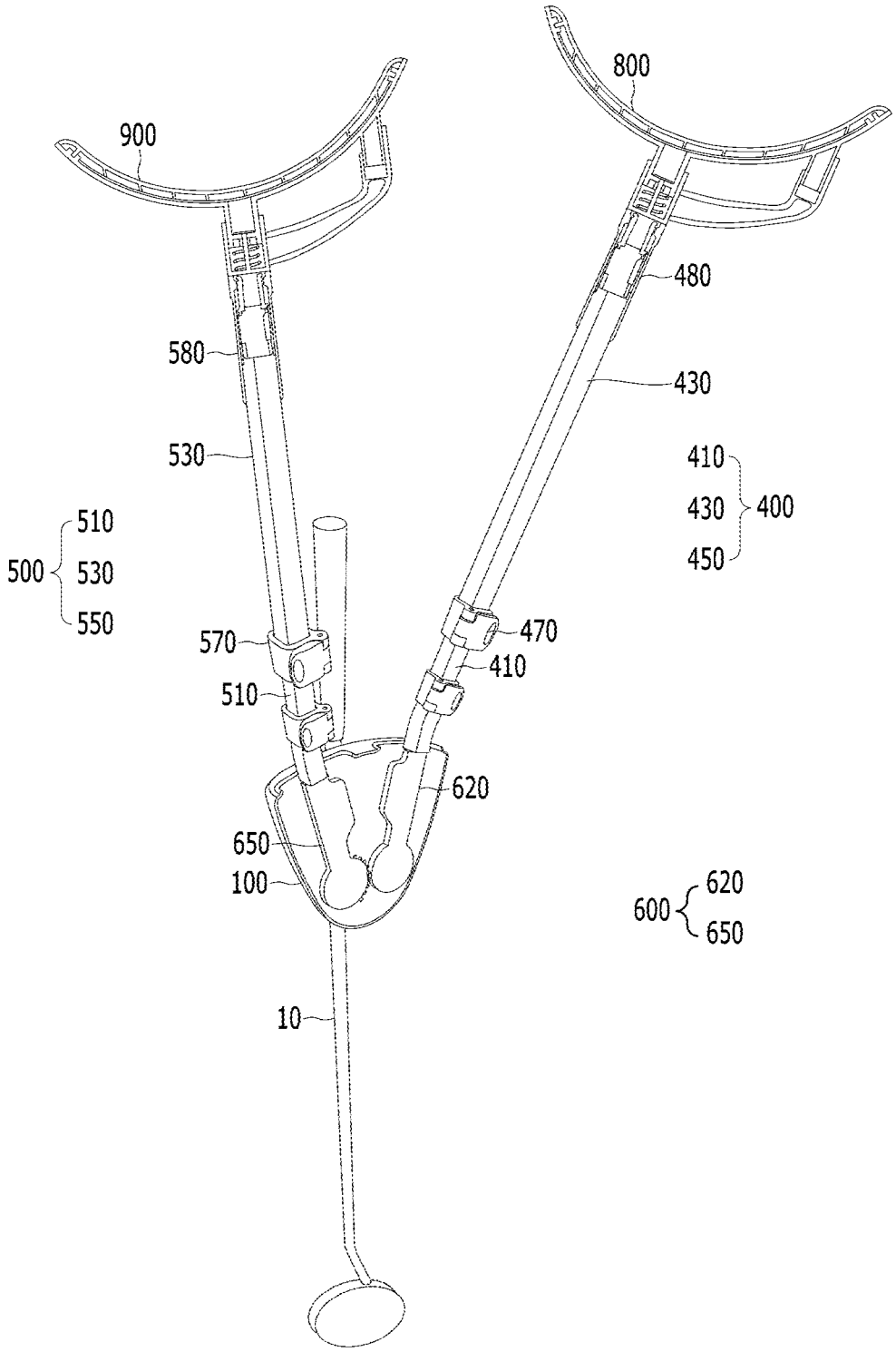
FIGS. 12 and 13 are views showing a putting training device according to another embodiment of the present invention.
Figure 13:
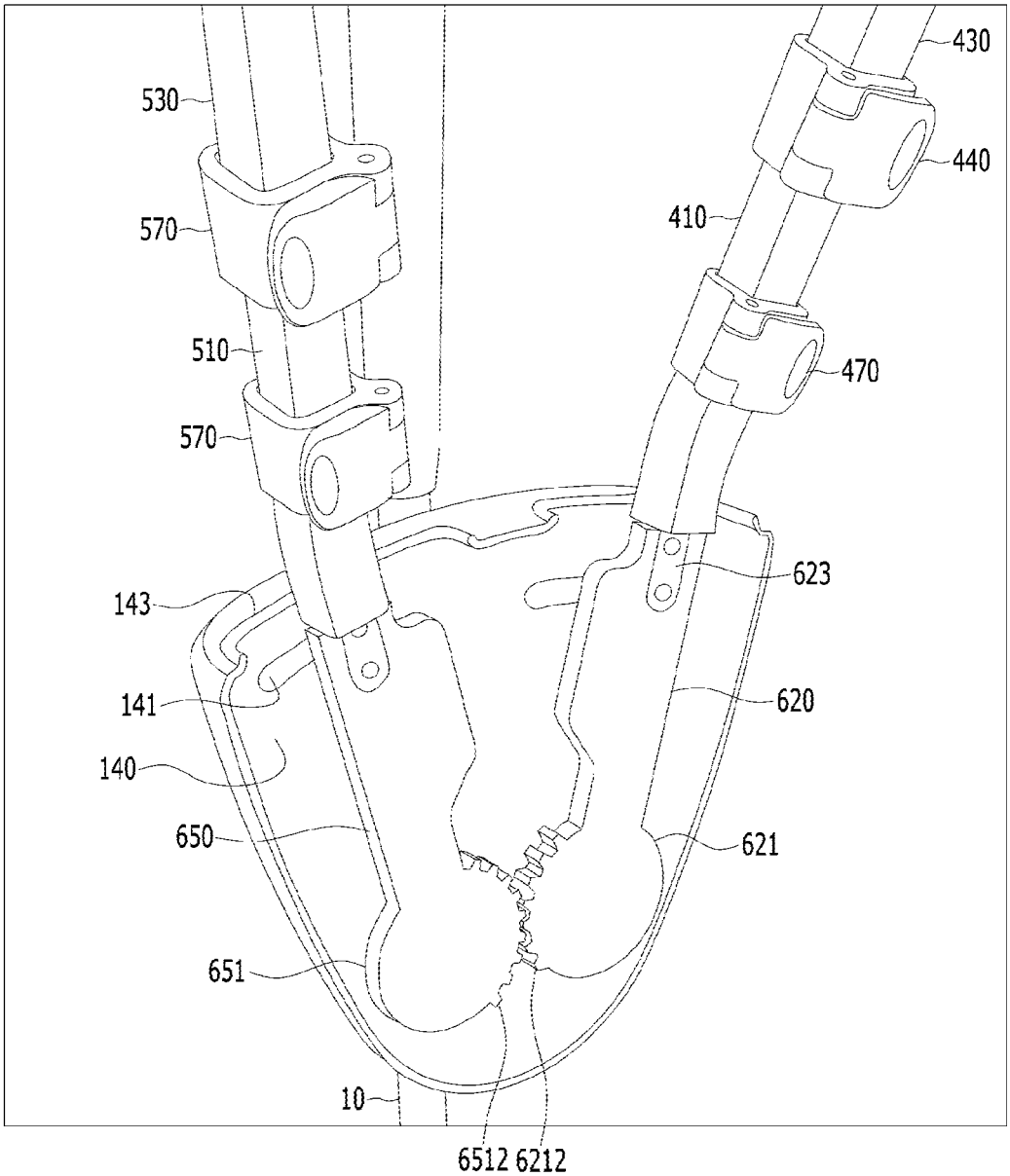

FIGS. 12 and 13 are views showing a putting training device according to another embodiment of the present invention.

The putting training device can be applied to training a user in a putting posture formed by relative positions of the user's shoulders and the user's hands holding a grip of a putter 10. For example, it has been known as being preferable that the user's shoulders and the user's hands holding the grip of the putter 10 make an inverse triangle as a putting posture. The putting training device of this embodiment helps keep a preferable putting device from the start to the end of a stroke. In particular, the putting training device has an advantage that a training effect can be memorized in the body of a user because it is directly applied to the body, and it has a simple structure, is smoothly operated in swinging, and is easily handled.

The putting training device may include a fixing hub 100, a first support bar 400, a second support bar 500, an angle adjuster 600, a first underarm part 800, and a second underarm bar 900.

Hereafter, directions or positional relationships are described on the basis of the putter 10 in a preparation state with the head of the putter 10 positioned close to a golf ball.

Figure 14:
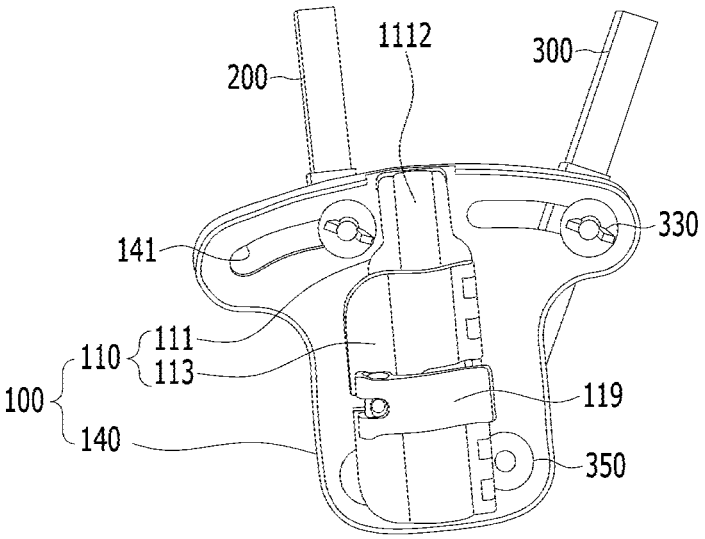
FIG. 14 is a view for describing an embodiment of a underarm part and a support bar of the putting training device according to another embodiment of the present invention.

FIG. 14 is a view for describing an embodiment of the fixing hub 100 of the putting training device according to another embodiment of the present invention.

Referring to FIGS. 12 to 14, the fixing hub 100 may include a shaft retainer 110 and a fixing frame 140.

The fixing frame may be metal or plastic injection molding or molding formed by a mold. Unlikely, the fixing frame 140 may be formed in a frame shape formed by welding or bolting a metallic plate or band member.

The shaft retainer 110 is coupled to the fixing frame 140 and may be coupled to the outer side of the shaft of a putter under the grip of the putter.

In this embodiment, the angle adjuster 600 is coupled to the front face of the fixing frame 140 and the shaft retainer 110 is coupled to the rear face of the fixing frame 140. However, the shaft retainer 110 being coupled to the front face of the fixing frame 140 is not excluded.

The shaft retainer 110 may have a partial hollow cylindrical shape. The shaft retainer 110 may be combined with a putter shaft such that a putter shaft under a putter grip is vertically positioned in the hollow cylindrical shape. The shaft retainer 110 may have an appropriate structure to which a putter shaft can be coupled or fixed such as an openable pipe shape or sleeve shape, or an openable ring member.

For example, the shaft retainer 110 may include a first fixing part 111, a second fixing part 113, and a pressing part 119.

The first fixing part 111 may be coupled to the rear face of the fixing frame 140, and a guide groove 1112 being open rearward and recessed forward further than the rear face of the fixing frame 140 may be formed on the first fixing part 111 such that the outer side of a shaft comes in contact with it.

The second fixing part 113 rotates with respect to the first fixing part 111 and can come in contact with the outer side of a shaft from behind.

The pressing part 119 can bring the first fixing part 111 and the second fixing part 113 in close contact with a shaft to fix the shaft with the first fixing part 111 and the second fixing part 113 fitted to surround the outer side of the shaft.

The angle adjuster 600 may be coupled to the fixing frame 140 and may be coupled to the lower portion of the first fixing bar 400 and the lower portion of the second fixing bar 500. The angle adjuster 600 may have a rotary structure or a gear structure that rotates to be able to adjust the contained angle between the first support bar 400 and the second support bar 500.

For example, the gear structure may include a first rotary support 620 and a second rotary support 650.

The first rotary support 620 is coupled to the lower portion of the first support bar 400 and may have a gear teeth 6212 formed on the side of the lower end 621.

The second rotary support 2 is coupled to the lower portion of the second support bar 500 and may have a gear teeth 6512 formed on the side of the lower end 651 to rotate in mesh with the gear teeth of the first rotary support.

The rear face of the lower end 621 of the first rotary support 620 and the rear face of the lower end 651 of the second rotary support 650 may be rotatably coupled to the fixing frame 140.

Guide holes 141 may be formed at the fixing frame 140 to correspond to the rear face of the upper end 631 of the first rotary support 620 and the rear face of the upper end of the second rotary support 650.

Fasteners may be fastened to the rear face of the upper end 623 of the first rotary support 620 and the rear face of the upper end of the second rotary support 650 through the guide holes 141. The fasteners can be moved along the guide holes 141 to adjust the contained angle, and accordingly, the contained angle between the first rotary support 620 and the second rotary support 650 is increased or decreased, in which the gear teeth 6212 and 6512 described above can be rotated in mesh with each other.

The first support bar 400 and the second support bar 500 may be positioned between the fixing hub 100 and the underarms of a user, respectively.

The first support bar 400 may include a lower bar 410, an upper bar 430, and a length adjustment lock 470.

The lower portion of the lower bar 410 may have a rod or pipe shape coupled to the first rotary support 620 and extending upward.

The upper bar 430 may be coupled to the upper end of the lower bar 410. For example, one of the upper end of the lower bar 410 and the lower end of the upper bar 430 is slid and inserted in the other one.

The length adjustment lock 470 is formed at at least one of the lower bar 410 and the upper bar 430, and in this embodiment, it is formed at the lower bar 410. It is possible to prevent sliding by tightening the length adjustment lock after adjusting the length by sliding the upper bar 430 and the lower bar 410.

The second support bar 500, in relationship with the second rotary support 650, includes a lower bar 510, an upper bar 570, and a length adjustment lock 570 in the similar way to the first support bar 400.

In this embodiment, the angle adjuster 600 is positioned on the front face of the fixing frame 140 and the shaft retainer 110 is coupled to the rear face of the fixing frame 140. The lower bar 410 of the first support bar 400 and the lower bar 510 of the second support bar 400 are respectively coupled to the upper end of the first rotary support 620 and the upper end of the second rotary support 650, and extend upward from the front face of the fixing frame 140.

Figure 15:
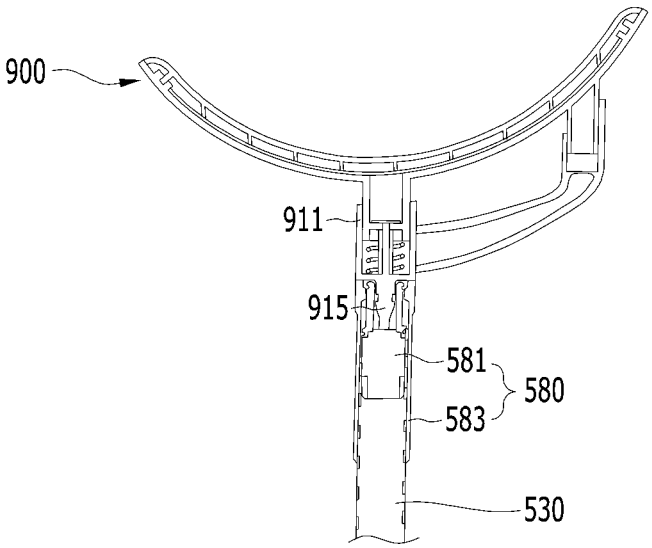
FIG. 15 is a view for describing an embodiment of a fixing hub of the putting training device according to another embodiment of the present invention.
Figure 15:
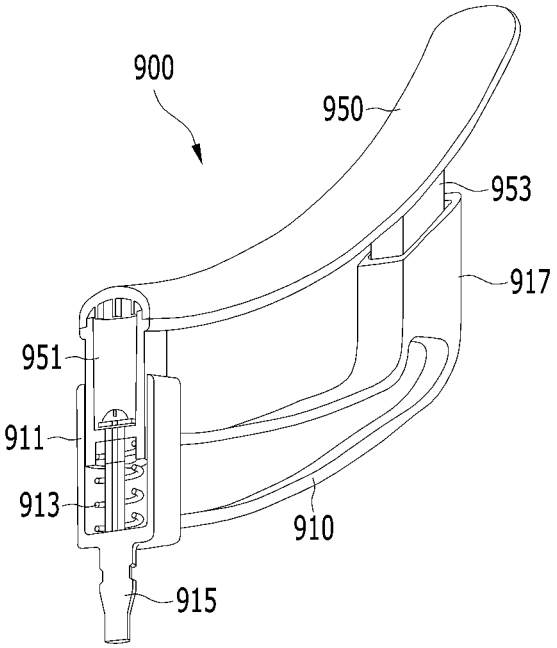

FIG. 15 is a view for describing an embodiment of a underarm part and a support bar of the putting training device according to another embodiment of the present invention.

A first underarm part and a second underarm part correspond to each other, so the second underarm part is described.

The second support bar 500 may further include a connection unit 580 coupled to the upper end of the upper bar 530.

The connection unit 580 may include a fastening part 581 fitted in the upper end of the upper bar 530, and a support member 583 in which the upper end of the upper bar 530 is inserted and that supports the second underarm part 900.

The second underarm part 900 may be coupled to the upper end of the second support bar 500, that is, the upper end of the upper bar 530. The second underarm part 900 may include an underarm support portion 910 having an accommodation groove 911, an underarm surface 950, and an elastic member 913.

The underarm surface 950 is coupled to the underarm support portion 910 and may have a top surface that comes in contact with an underarm of a user. The elastic member 913 is inserted in the accommodation groove 911 and can elastically support the underarm surface 950.

The first underarm part 800, in the relationship with the first support bar 400, may include an underarm support portion, an underarm surface, and an elastic member in the same way as the second underarm part 900.

The underarm support portion 910 may further include a support arm, a support groove 917, and an insert 915.

The support arm extends under the underarm surface 950 from the accommodation groove 911. The support groove 917 is formed at an end of the support arm. The insert 915 protrudes from the bottom of the accommodation groove 911 and can be inserted in the upper end of the upper bar 530.

In detail, the insert 915 can be locked to the fastening part 581 of the connection unit 580 described above. That is, the insert 915 is inserted and locked in the fastening part 581 and can be unlocked and separated by external force. In other words, the insert can be very easily attached/detached. The bottom of the accommodation groove 911 can be supported by the support member 583 described above.

Meanwhile, the underarm surface 950 may include a seat smoothly curved to be held in an underarm, and a first coupling protrusion 951 and a second coupling protrusion 953.

The first coupling protrusion 951 protrudes from the bottom of the seat, is inserted in the accommodation groove 911, and can be elastically supported by the elastic member 913. The second coupling protrusion 953 can protrude from the bottom of the seat and can be inserted in the support groove 917.

If the structure connected from the support bars 400 and 500 to the underarm parts 800 and 900 cannot be changed in length, when a user swings such as putting with the underarm parts 800 and 900 under the arms, swing may be inconvenient and putting training may not be achieved well.

In this embodiment, since the underarm surface 950 is elastically supported by the elastic member 913, for example, a coil spring, so it can be compressed and restored. Accordingly, the length of the structure connected from the support bar to the underarm part is increased/decreased in accordance with the user's body or a swing type, so it is advantageous in actions fitting to the body shape and it is possible to remove unpleasantness in use.

Figure 16:
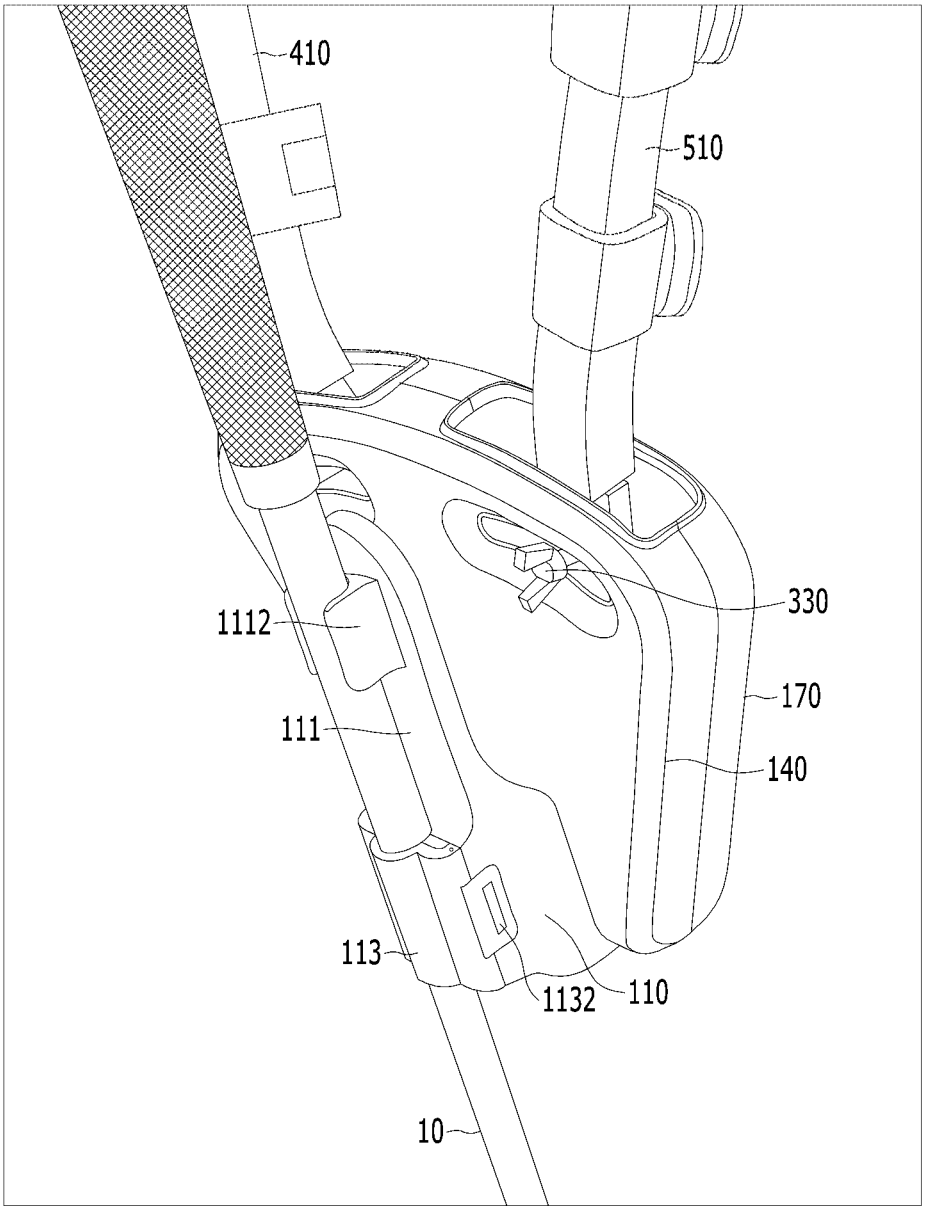
FIGS. 16 and 17 are views showing a putting training device according to another embodiment of the present invention.
Figure 17:
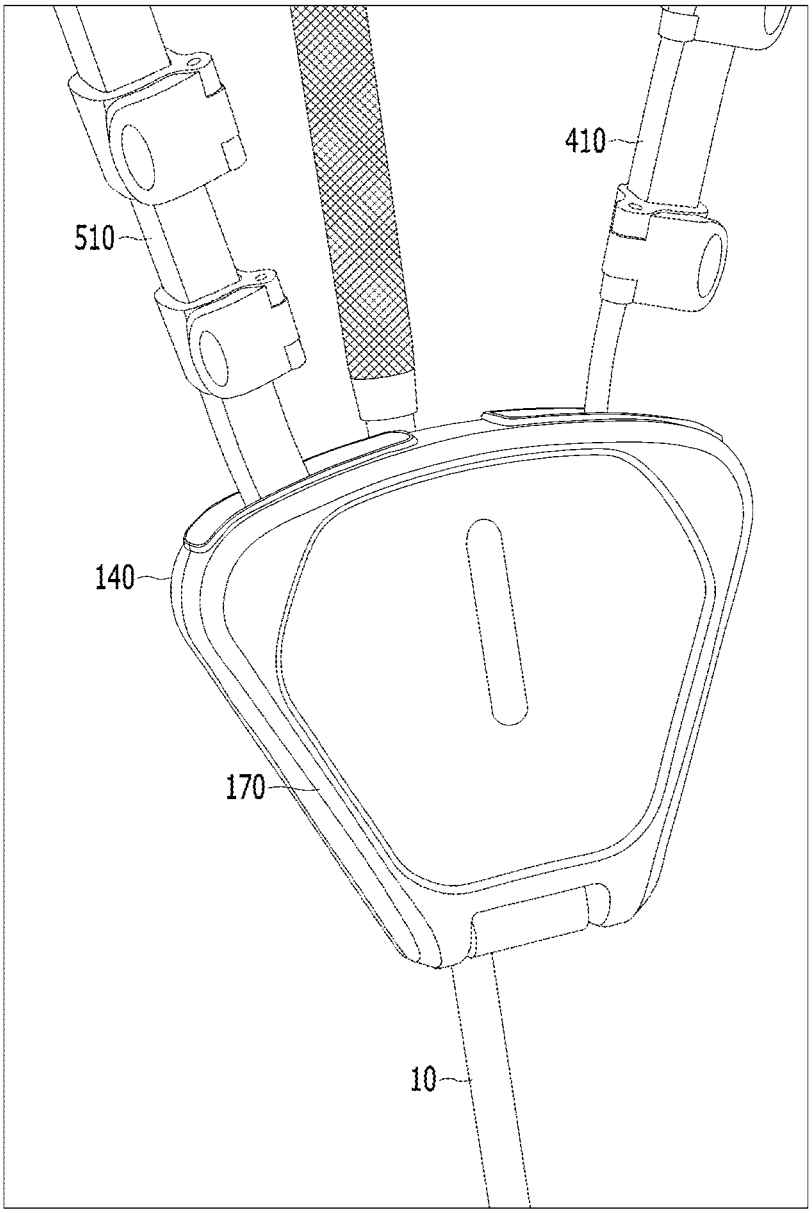

FIGS. 16 and 17 are views showing a putting training device according to another embodiment of the present invention.

In the putting training device shown in FIGS. 16 and 17, the shaft retainer 110 and the angle adjuster 600 are coupled to the fixing frame 140 with the fixing frame 140 therebetween. In detail, the angle adjuster 600 is coupled to the front face of the fixing frame 140 and the shaft retainer 110 is coupled to the rear face of the fixing frame 140.

The putting training device may further include a cover 170 coupled to the fixing frame 140 to cover the angle adjuster 600.

The angle adjuster 600 is positioned on the front face of the fixing frame 140 and has a gear structure with gear teeth, so it is required to protect the angle adjuster 600 from the outside for safety of a user or maintenance of the putting training device. The cover 170 can perform this protection.

Further, cut grooves that are fitted to each other are formed at the upper end of the cover 170 and the upper end of the fixing frame 140, thereby being able to limit the rotation range of the lower bars 410 and 510 within the length of the cut grooves (see FIG. 16).

Meanwhile, in this embodiment, the shaft retainer 110 is coupled to the rear face of the fixing frame 140, but is separated from the guide groove 1112 such that the second fixing part 113 covers a shaft. Since the second fixing part 113 is coupled to a one-touch type locking part 1132, there is the advantage that a putter can be very easily attached/detached.

Figure 18:
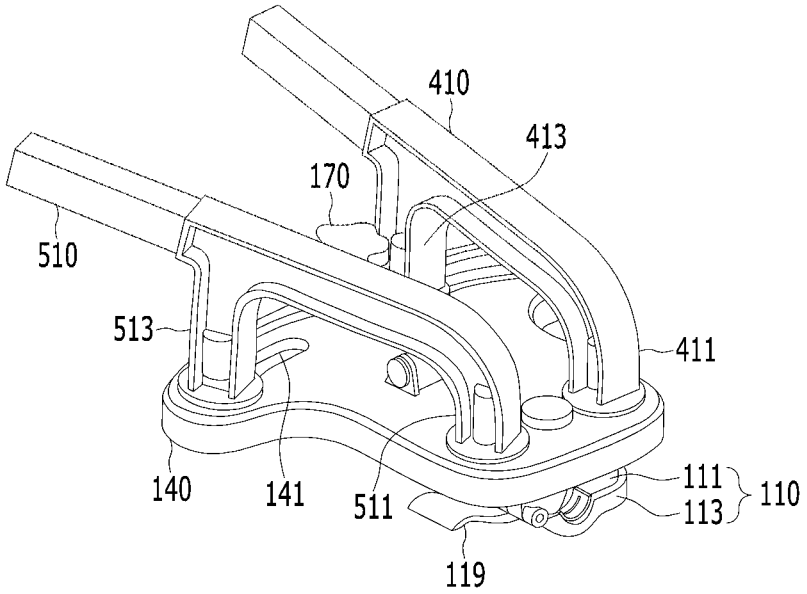
FIGS. 18 and 19 are views showing a putting training device according to another embodiment of the present invention.
Figure 19:
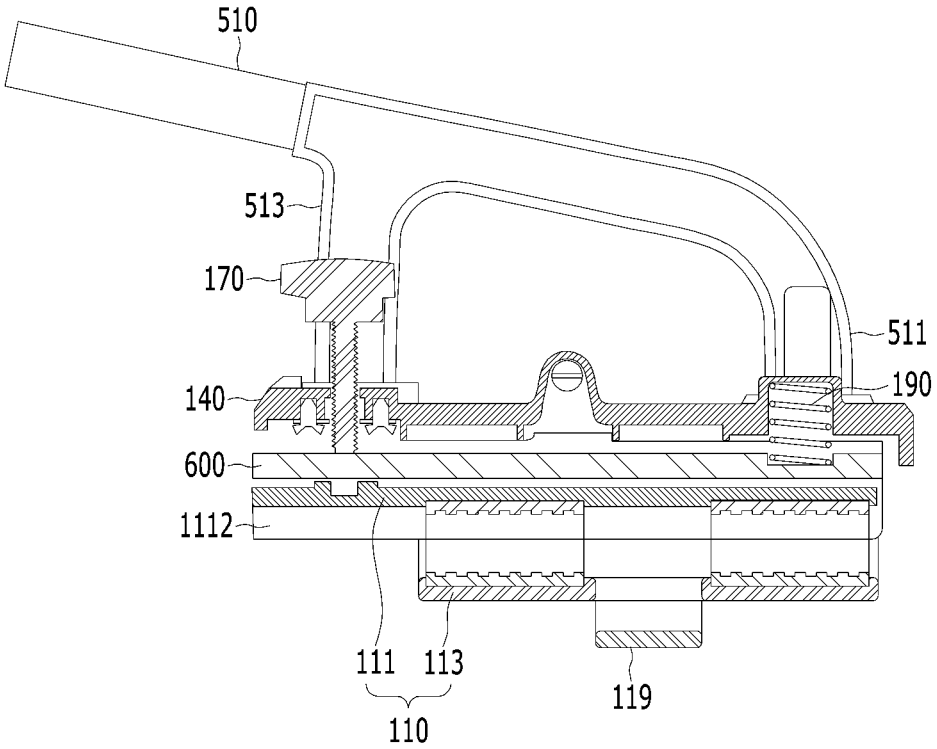

FIGS. 18 and 19 are views showing a putting training device according to another embodiment of the present invention.

In the embodiment shown in FIGS. 18 and 19, the shaft retainer 110 is positioned on the rear face of the fixing frame 140 and the angle adjuster 600 is positioned between the rear face of the fixing frame 140 and the shaft retainer 110.

The lower bar 410 of the first support bar 400 may have connecting portions 411 and 413 extending rearward from the front face of the fixing frame 140 and respectively coupled to the rear face of the upper end and the rear face of the lower end of the first rotary support 620.

The lower bar 510 of the second support bar 500 may also have connecting portions 511 and 513 in the similar way for the second rotary support 650.

As described above, the spaced distance of the support bars 400 and 500 forward from a putter can be increased by the connecting portions 411, 413, 511, and 513. It may be more suitable to increase the positions of a putter and the support bars more than the embodiment described with reference to FIGS. 12 to 15, depending on users.

In this case, as shown in FIGS. 18 and 19, it is possible to protect the angle adjuster 600 from the outside by installing it between the fixing frame 140 and the shaft retainer 11.

In the embodiments described above, since gear teeth are rotated in mesh with each other and the angle is adjusted by the structure of the angle adjuster 600, it is possible to more accurately adjust the angle (contained angle) between the support bars and uniformly increase or decrease the distance between the first support bar 400 and the second support bar 500 with respect to a center line.

Further, rotation can be more firmly and reliably performed by the angle adjuster 600 having a gear teeth mesh type.

The putting training devices of the embodiments described above can be conveniently attached/detached by the one-touch type underarm parts, and can be flexibly applied to fit to the user's body when the user swings because the elastic members 913 support the underarm parts.

Further, in the embodiment in which the guide groove 1112 formed at the shaft retainer 110 is recessed forward from the fixing frame, a shaft can be positioned closer to the support bars.

Further, the putting training devices are very convenient to use and have the advantage in handling and storing in that the support bars can be adjusted in length and be easily attached/detached, the devices can be easily fitted to the body of a user by adjusting the height and angle, and a putter shaft can be conveniently attached/detached to/from the shaft retainer 110.

According to the putting training devices of the embodiments, there is a kind of effect that fixes relative positions so that the positions of shoulders and hands are not separately moving. That is, a user can maintain an inverse triangular structure made by the shoulders and hands when stroking, so the putter 10 is stably moved like a pendulum motion, so it is possible to hit a golf ball square through a club face (head). By repeating the action, the muscles of the body memorize a stable and preferable putting motion, thereby being able to achieve effective putting training. Accordingly, it is possible to accomplish the effect that improves the number of putting and a golf score.

Figure 20:
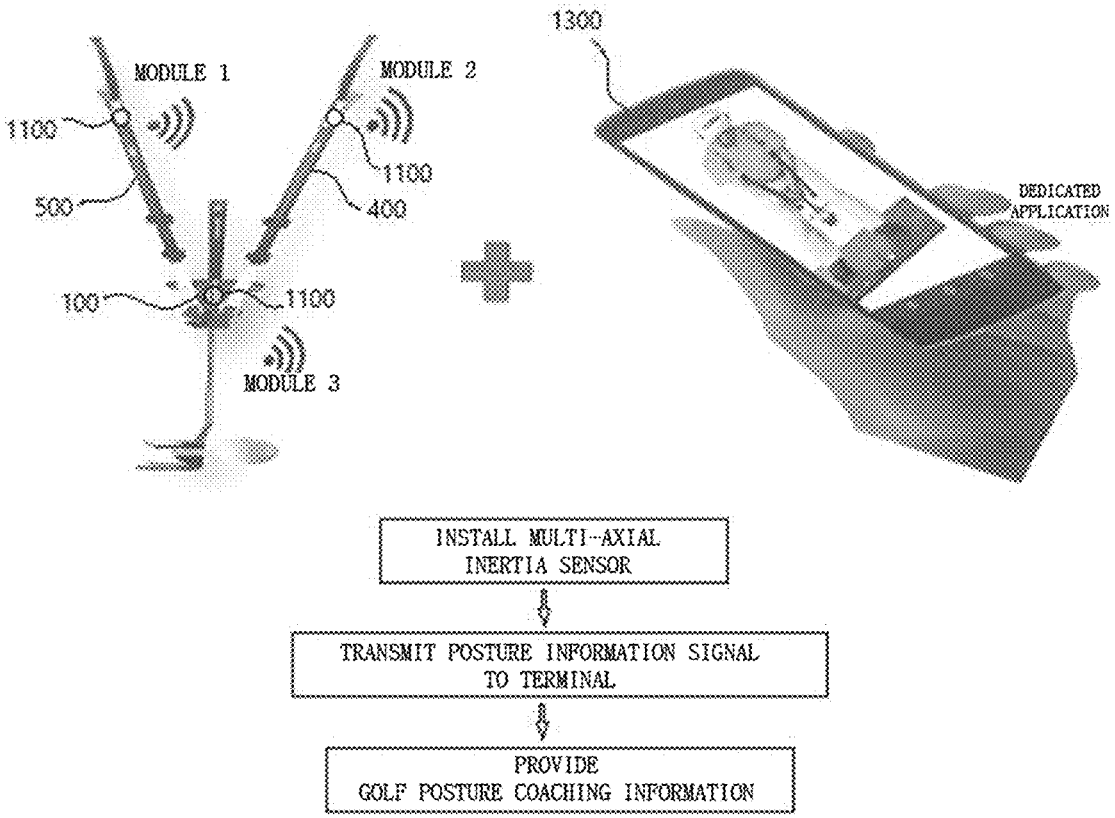
FIG. 20 is a view showing a method of providing swing posture coaching information according to another embodiment of the present invention.

FIG. 20 is a view showing a method of providing swing posture coaching information according to another embodiment of the present invention.

A method of providing swing posture coaching information can provide information that coaches a user to correct a swing posture using a swing posture training device and a terminal. The putting training device described above may be used as the swing posture training device and a smartphone may be used as the terminal.

First, a multi-axial inertia sensor that measures three-axial acceleration and positions, and direction is installed at the putting training device.

The multi-axial inertia sensor 1100 may be installed at the first support bar 400, the second support bar 500, and the fixing hub 100, respectively. The multi-axial inertia sensor 1100 may be installed at the angle adjuster 600 of the fixing hub 100, or may be installed at the fixing frame 140 or the shaft retainer 110.

The multi-axial inertia sensor is, for example, a six-axial inertia sensor, and may include an acceleration sensor that senses three-axial acceleration, a gyroscope sensor that measures positions and directions in a space, and a Bluetooth unit that transmits posture information signals obtained from the above sensors to a smartphone.

The terminal may be a smartphone 1300 and dedicated software may be a dedicated putting posture training application installed in the smartphone 1300.

Thereafter, when a user swings or putts, a posture information signal including three-axial acceleration, position, and direction information sensed by the multi-axial inertia sensor 1100 is transmitted to the smartphone 1300 by the Bluetooth unit, as described above. Other communication methods different from Bluetooth can also be used for communication.

Thereafter, the posture information signal is processed through the dedicated putting posture training application installed in the terminal, whereby swing posture coaching information is provided to the user.

The dedicated application, for example, can receive posture information signals from three multi-axial inertia sensors 1100 installed at the first support bar 400, the second support bar 500, and the fixing hub 100.

The dedicated application can derive X-axial, Y-axial, and Z-axial acceleration and force from the posture information signal obtained from the acceleration sensor and can derive the movement direction of the user's arms and the rotational direction of the user's hands from the posture information signal obtained by the gyroscope sensor.

Further, the dedicated application determines the points in time of starting and finishing swinging or putting from the point in time when the sign of specific axial signal of the X, Y, and Z axes changes on the basis of the derived information, and derives a height change by accumulating data about the movement direction of the arms and the rotational direction of the hands, thereby being able to create swing posture coaching information.

That is, it is possible to obtain the difference between the type of swinging and a preferable or recommended type, and transmits swing posture coaching information for correcting the swinging to the user through a smartphone using a voice or text.

The dedicated application can provide a fundamental menu including a sensor connection and state menu of the multi-axial inertia sensor, a menu saving a user's basic posture or a recommended basic posture, and a practice posture comparison menu that compares practice postures of a user or comparing a practice posture of a user and a basic posture.

A user may select appropriate practice types or practice courses in accordance with his/her need, taste, or level in golf by selecting the menus.

Further, the swing posture coaching information may include correction announcements that are stored in advance in a DB type in accordance with swing types and transmitted to a user through a smartphone.

The above description is provided as an exemplary embodiment of the present invention and it should be understood that the present invention may be easily modified in other various ways without changing the spirit or the necessary features of the present invention by those skilled in the art. Therefore, the embodiments described above are only examples and should not be construed as being limitative in all respects. For example, the components described as single parts may be divided and the components described as separate parts may be integrated.

The scope of the present invention is defined by the following claims, and all of changes and modifications obtained from the meaning and range of claims and equivalent concepts should be construed as being included in the scope of the present invention.

According to an embodiment of the present invention, it is possible to provide a putting training device that has a simple structure, is convenient to assembly and separate, and can train a user in a putting posture directly on the user's body.

According to an embodiment of the present invention, since gear teeth are rotated in mesh with each other and the angle is adjusted by the structure of the angle adjuster, it is possible to more accurately adjust the angle and uniformly increase or decrease the distance between the first support bar and the second support bar with respect to a center line.

Further, rotation can be more firmly and reliably performed by the angle adjuster having a gear teeth mesh type.

Further, the putting training device can be conveniently attached/detached by the one-touch type underarm parts, and can be flexibly applied to fit to the user's body when the user swings because the elastic members support the underarm parts.

Further, in the embodiment in which the guide groove formed at the shaft retainer is recessed forward from the fixing frame, a shaft can be positioned closer to the support bars.

Further, the putting training devices are very convenient to use and have the advantage in handling and storing in that the underarm parts can be adjusted in length and be easily attached/detached, the devices can be easily fitted to the body of a user by adjusting the height and angle, and a putter shaft can be conveniently attached/detached to/from the shaft retainer.

Further, it is possible to provide a method of providing coaching information for correcting a swing posture by installing a sensor on a putting training device and installing a dedicated application in a smartphone.

The effects of the present invention are not limited thereto and it should be understood that the effects include all effects that can be inferred from the configuration of the present invention described in the following specification or claims.

What is claimed is:

1. A putting training device configured for training a user in a putting posture formed by relative positions of the user's shoulders and the user's hands holding a grip of a putter, the putting training device comprising:

a fixing hub including a shaft retainer configured to be combined with a putter shaft, and a block part formed at an upper end of the shaft retainer;

a first rotary support and a second rotary support coupled to the block part;

a first support bar having an upper end configured to be held in a first underarm of the user and a lower end rotatably coupled to the first rotary support;

a second support bar having an upper end configured to be held in a second underarm of the user and a lower end rotatably coupled to the second rotary support; and an angle adjuster coupled to the first support bar and the second support bar so as to adjust an angle between the first support bar and the second support bar, wherein each of the first rotary support and the second rotary support has a rod shape protruding from the block part, and wherein the lower ends of the first support bar and the second support bar are respectively coupled to the first rotary support and the second rotary support at positions spaced apart from the block part.

2. The putting training device of claim 1, wherein the shaft retainer includes:

a first fixing part having a shape corresponding to a first half of a cylindrical shape of the putter shaft;

a second fixing part having a shape corresponding to a second half of the cylindrical shape of the putter shaft; and a fastener configured to be fastened to the first fixing part and the second fixing part to fix the putter shaft in a hollow cylindrical space formed by the first fixing part and the second fixing part.

3. The putting training device of claim 2, wherein one of the first fixing part and the second fixing part is integrally formed with the block part, and the other one of the first fixing part and the second fixing part is configured to be rotated with respect to the one of the first fixing part and the second part to open and close the shaft retainer.

4. The putting training device of claim 1, wherein the lower ends of the first support bar and the second support bar include:

rotary members coupled to the first rotary support and the second rotary support and configured to rotate forward and rearward; and connecting parts coupled to the rotary members and configured to rotate left and right.

5. The putting training device of claim 1, wherein each of the first support bar and the second support bar includes:

a lower bar having the lower end rotatably coupled to the first or second rotary support;

an upper bar coupled to the lower bar such that an upper end of the lower bar is slid in or on the upper bar to adjust a length of the first or second support bar;

a length adjustment lock configured for preventing the lower bar from sliding; and an underarm part detachably attached to an upper end of the upper bar, and having a partial arc shape to be held in the first or second underarm.

6. The putting training device of claim 5, wherein the lower bar and the upper bar respectively have a rectangular cross-section, and a height scale is formed on a surface of the lower bar.

7. The putting training device of claim 5, wherein the angle adjuster includes:

an angle adjustment frame having guide holes for adjusting an angle between the first support bar and the second support bar, having an angle adjustment scale at an upper edge thereof so that the user can recognize the angle adjustment scale when looking down, and coupled to the lower bars of the first support bar and the second support bar from behind; and a pair of angle adjustment locks having ends respectively fastened to the lower bars and another ends being slid and fixed in the guide holes.

8. A putting training device configured for training a user in a putting posture formed by relative positions of the user's shoulders and the user's hands holding a grip of a putter, the putting training device comprising:

a fixing hub including a shaft retainer configured to be coupled to an outer side of a shaft of the putter, and a fixing frame to which the shaft retainer is coupled;

a first support bar and a second support bar configured to be held in a first and a second underarms of the user, respectively;

a first underarm part and a second underarm part coupled to upper ends of the first support bar and the second support bar, respectively, and configured to be held in the first and the second underarms of the users, respectively; and an angle adjuster coupled to the fixing frame, coupled to a lower portion of the first support bar and a lower portion of the second support bar, and having a gear structure configured for rotating to adjust a contained angle between the first support bar and the second support bar, wherein the gear structure includes:

a first rotary support coupled to the lower portion of the first support bar and having gear teeth on a side of a lower end of the first rotary support; and a second rotary support coupled to the lower portion of the second support bar and having gear teeth on a side of a lower end of the second rotary support to rotate in mesh with the gear teeth of the first rotary support.

9. The putting training device of claim 8, wherein each of the first underarm part and the second underarm part includes:

an underarm support coupled to an upper end of the first or second support bar and having an accommodation groove;

an underarm surface coupled to the underarm support and having a top surface configured to be in contact with the first or second underarm of the user; and an elastic member disposed in the accommodation groove for elastically supporting the underarm support.

10. The putting training device of claim 8, wherein the angle adjuster is coupled to a front face of the fixing frame, and the shaft retainer is coupled to a rear face of the fixing frame, and wherein the shaft retainer includes:

a first fixing part having a guide groove open rearward and recessed forward further than the rear face of the fixing frame such that the outer side of the shaft comes in contact with the first fixing part;

a second fixing part configured for rotating with respect to the first fixing part to be in contact with the outer side of the shaft from behind; and a pressing part configured for bringing the first fixing part and the second fixing part in contact with the shaft to fix the shaft by surrounding the outer side of the shaft with the first fixing part and the second fixing part.

11. The putting training device of claim 8, wherein each of the first support bar and the second support bar includes:

a lower bar having a lower portion coupled to the first or second rotary support and extending upward;

an upper bar coupled to an upper end of the lower bar and configured such that one of the upper end of the lower bar and a lower end of the upper bar is fitted and slid on the other one; and a length adjustment lock disposed on at least one of the lower bar and the upper bar for preventing sliding.

12. A putting training device configured for training a user in a putting posture formed by relative positions of the user's shoulders and the user's hands holding a grip of a putter, the putting training device comprising:

a fixing hub including a shaft retainer configured to be coupled to an outer side of a shaft of the putter, and a fixing frame to which the shaft retainer is coupled;

a first support bar and a second support bar positioned between the fixing hub and underarms of the user, respectively;

an angle adjuster coupled to the fixing frame, coupled to a lower portion of the first support bar and a lower portion of the second support bar, and having a rotary structure configured to adjust a contained angle between the first support bar and the second support bar; and a first underarm part and a second underarm part coupled to upper ends of the first support bar and the second support bar, respectively, and configured to be held in the underarms of the users, respectively, wherein each of the first underarm part and the second underarm part includes:

an underarm support coupled to an upper end of the first or second support bar and having an accommodation groove, an underarm surface coupled to the underarm support and having a top surface configured to be in contact with an underarm of the user, and an elastic member disposed in the accommodation groove for elastically supporting the underarm support.

13. The putting training device of claim 12, wherein the rotary structure includes:

a first rotary support coupled to the lower portion of the first support bar and having gear teeth on a side of a lower end of the first rotary support; and a second rotary support coupled to the lower portion of the second support bar and having gear teeth on a side of a lower end of the second rotary support to rotate in mesh with the gear teeth of the first rotary support.

14. The putting training device of claim 12, wherein the underarm support includes:

a support arm extending under the underarm surface from the accommodation groove;

a support groove formed at an end of the support arm; and an insert protruding from a bottom of the accommodation groove to be inserted in an upper end of the first support bar, and wherein the support surface includes:

a seat curved to be held in the underarm;

a first coupling protrusion protruding from a bottom of the seat, disposed in the accommodation groove, and elastically supported by the elastic member; and a second coupling protrusion protruding from the bottom of the seat to be inserted in the support groove.

15. A method of providing swing posture coaching information using a signal transmitted from a multi-axial inertia sensor, the method comprising:

installing the multi-axial inertia sensor configured to measure three-axial acceleration, positions, and directions at the putting training device of claim 12;

transmitting a posture information signal including the three-axial acceleration, positions, and directions measured by the multi-axial inertia sensor to a terminal when a user swings or putts; and providing swing posture coaching information to the user by processing the posture information signal through a dedicated putting posture training application installed in the terminal.

16. The method of claim 15, wherein the multi-axial inertia sensor is installed at the first support bar, the second support bar, and the fixing hub, the terminal is a smartphone, and the dedicated putting posture training application is installed in the smartphone.

17. The method of claim 15, wherein the multi-axial inertia sensor includes:

an acceleration sensor configured to sense the three-axial acceleration;

a gyroscope sensor configured to measure the positions and directions; and a Bluetooth unit configured to transmit posture information signals to the terminal.

* * * * *